US005831245A

United States Patent [19]

Debourg et al.

[11] Patent Number: 5,831,245

[45] Date of Patent: Nov. 3, 1998

[54] ELECTRONICALLY HEATED HANDHELD APPLICATOR FOR THERMOFUSIBLE MATERIAL WITH POWER SUPPLY BLOCK FUNCTIONING AS A SUPPORT

[75] Inventors: Jean-Pierre Debourg, Lyon; Daniel Bontoux, Saint-Genis-Laval, both of France

[73] Assignee: SEB S.A., Ecully, France

[21] Appl. No.: 719,534

[22] Filed: Sep. 25, 1996

[30] Foreign Application Priority Data

Oct. 3, 1995 [FR] France ..... 95 11620

[51] Int. Cl.[6] ..... A45D 26/00; A45D 40/26; H05B 3/00

[52] U.S. Cl. ..... 219/242; 219/227; 401/1; 222/146.5

[58] Field of Search ..... 219/242, 227–231, 219/221; 401/1, 2; 222/146.5

[56] References Cited

U.S. PATENT DOCUMENTS

| | | | |
|---|---|---|---|
| 1,109,034 | 9/1914 | Bryan | 401/1 |
| 1,129,900 | 3/1915 | Proctor et al. | 401/2 |
| 1,769,437 | 7/1930 | Kromer | 401/1 |
| 2,097,974 | 11/1937 | Goodchild | 219/242 |
| 2,577,721 | 12/1951 | Belak | 401/1 |
| 3,459,335 | 8/1969 | Cohen et al. | 222/146.5 |
| 3,513,290 | 5/1970 | Burley et al. | 219/242 |
| 4,692,587 | 9/1987 | Spirk, Jr. et al. . | |
| 4,773,784 | 9/1988 | Mann | 401/1 |
| 4,826,049 | 5/1989 | Speer . | |
| 5,219,237 | 6/1993 | Zonneveld | 401/1 |
| 5,395,175 | 3/1995 | Bontoux et al. | 401/1 |
| 5,526,829 | 6/1996 | Smith | 132/229 |

FOREIGN PATENT DOCUMENTS

| | | | |
|---|---|---|---|
| 368698 | 5/1990 | European Pat. Off. . | |
| 499 317 | 8/1992 | European Pat. Off. . | |
| 592 340 | 4/1994 | European Pat. Off. . | |
| 629 366 | 12/1994 | European Pat. Off. . | |
| 786214 | 7/1997 | European Pat. Off. . | |
| 2534190 | 4/1984 | France . | |
| 749381 | 5/1944 | Germany | 219/228 |
| 2414895 | 10/1975 | Germany . | |
| 2935759 | 3/1981 | Germany | 401/1 |
| 2936961 | 4/1981 | Germany | 401/1 |
| 622148 | 6/1961 | Italy | 401/2 |
| 603821 | 6/1948 | United Kingdom | 219/228 |
| 2 113 994 | 8/1993 | United Kingdom . | |
| 89/10324 | 11/1989 | WIPO . | |
| 8910324 | 11/1989 | WIPO | 219/227 |

*Primary Examiner*—John A. Jeffery
*Attorney, Agent, or Firm*—Young & Thompson

[57] ABSTRACT

An applicator system for thermofusible material comprises an electric power supply block (1) and an applicator (3). An electric heater (8) for the applicator comprising a wire wrapped around a diagonally disposed support is placed directly inside a reservoir (4). The electric connection elements (11) of the electric heater (8) link the pins (13, 14) to the power supply block (1). The electric power supply is disconnected during the application of the material.

15 Claims, 1 Drawing Sheet

ELECTRONICALLY HEATED HANDHELD APPLICATOR FOR THERMOFUSIBLE MATERIAL WITH POWER SUPPLY BLOCK FUNCTIONING AS A SUPPORT

FIELD OF THE INVENTION

This invention relates to the general technical field of the application devices of thermofusible material, such as hair removing wax, ointments, creams, even glues or polishes, in which the material is stored in solid form and must be exposed to a calorific supply to change state and to take on a condition which is least pasty, so that it can be applied.

By thermofusible material, we mean any type of material which is, at room temperature, in a solid physical state, possibly semi-solid or pasty, but liable, under the action of heat, to change physical state in order to liquidize sufficiently so that it can be spread in the form of a coat.

The invention aims more particularly at protecting an application device and a hair removal wax applicator, but it is obvious that the application is not limited to this specific use.

BACKGROUND OF THE INVENTION

Whatever the type of application of hair removal wax is considered, the hair removal technique by application of a depilatory wax consists in melting a certain quantity of wax, then in applying in molten condition a coat of wax onto the zone to be unhaired. After hardening, i.e. cooling down, the film of cold wax can be removed via any appropriate means, whereby the hairs are extracted from the skin by being trapped in the wax.

The implementation of these techniques generally calls for the use of relatively cumbersome devices, giving rise to a long, tedious and often soiling hair removal operation.

In order to implement this technique, application devices constituted essentially of a heated tank for liquefying the hair removal wax are already known. These devices are completed by an applicator element, of the spatula or roller type, independent from the reservoir, that the user inserts into the mass of molten wax, in order to sample a certain quantity that she can spread onto the zone to be unhaired.

These simple devices, quite straightforward, often prove not to meet the more and more sophisticated requirements of the lady users.

The application temperature of the wax is not mastered correctly, the same goes for the application thickness of the wax coat onto the zone to be unhaired. Such devices produce numerous shortcomings and notably call for a long warm-up time.

In order to improve the conventional devices mentioned previously, application devices comprising a portable distribution element, connected to the reservoir by a flexible hose, have already been suggested. A pumping system would then drive the wax from the reservoir towards the hose, then towards the distribution element.

Such devices have generally a great autonomy and are well suited in the case a hair removal operation on a large zone. However, the device remains relatively cumbersome and requires a rather delicate handling.

In order to improve the previous devices still further, self-contained devices have been developed, notably that described in the application for European patent EP 629366, relating to an applicator of thermofusible material, especially hair removal wax. This device comprises a casing, associated with pick-up means, a reservoir for the material to be applied, made of a good heat conducting material, preferably aluminium. This reservoir is thermally linked with external heating means. At least one applicator roller has been arranged in the vicinity of an outlet orifice of the reservoir, in order to enable the application of the hair removal wax onto the zone requested.

Another device, of comparable design, has been developed in the application for U.S. Pat. No. 5,395,175 relating to an applicator of thermofusible material, particularly hair removal wax, also comprising a casing, associated with pick-up means, a reservoir for the material to be applied, and at least one applicator means of the material arranged in the vicinity of the outlet orifice of the reservoir. In the device described in this document, at least one section of the reservoir is made of an electric current conducting plastic material, thus constituting heating means.

Both these previous devices, compact in shape, enable to better master and control the application temperature of the wax, facilitate the use and cleaning of the devices, and limit the risks of soiling the environment.

Although improved, these previous devices do not always correspond to the present needs of the users.

SUMMARY OF THE INVENTION

The purpose of the present invention aims consequently at remedying the shortcomings of the previous devices and notably at providing an application device of the thermofusible material whose design and execution are particularly simplified, while allowing to satisfactorily master the application temperature of the thermofusible material.

Another purpose of the invention is to have an application device comprising electric connections which are particularly simple while thoroughly reliable, as well as means of application limiting the risk of crawling or untimely spreading.

It is another purpose of the invention to enable the lady to use the device easily over her body, even at places difficult of access, with a handy device, fitted with a self-contained applicator, whose simplified design enables easy miniaturization, for removing hairs on small zones, delicate of access, such as for instance around the mouth and more precisely above the upper lip, which signifies that the device must be compact and quite handy.

Another purpose is also to provide with an applicator whose filling level can be controlled readily.

In order to reach those targets, the invention relates to an applicator device of thermofusible material, especially hair removal wax, comprising an electric power supply block, an applicator consisting of a tank designed for containing a volume of the thermofusible material, and to enable picking up and handling the device, a distribution element arranged outside an outlet opening of the reservoir as well as heating means for the thermofusible material.

According to the invention, heating means are placed inside the reservoir so that they can be in contact with the thermofusible material, and temporary electric connection means enabling to link the power supply block to the heating means which then melt the thermofusible material, whereas the power supply is disconnected during the application of the material.

The invention also relates to the applicator designed for the device described previously, characterized in that its capacity is limited to a volume smaller than 10 $cm^3$.

According to various peculiar embodiments, the invention exhibits the following characteristics, considered individually or in all their technically possible combinations:

the power supply block delivers a very low voltage, ranging between 2.5 and 6 volts;

the electric connection means comprise a male section, fitted with two pins attached to the reservoir and connected to the heating means, enabling on the one hand to link the heating means to the power supply block and, on the other, a providing link of the applicator to the electric power supply block, serving as a support or seat;

the reservoir taken in a section parallel to the application plane has the shape of a quadrilateral and the heating means comprise a resistive electric wire placed on a support, whereby the support is placed in the same plane as one of the diagonals of the quadrilateral;

the reservoir is made of a plastic material;

at least one of the walls of the reservoir is partially constituted of a light-transparent material;

the distribution element is a roller;

the distribution roller is rather small, less than 2 cm in diameter and less than 2 cm in length;

the reservoir is of single fill-up version.

BRIEF DESCRIPTION OF THE DRAWINGS

Various other characteristics and advantages of the invention will become clearer in the light of the following description, given for exemplification purposes and without any limiting nature, in combination with the appended drawings on which.

DESCRIPTION OF THE PREFERRED EMBODIMENTS

Figure 1:
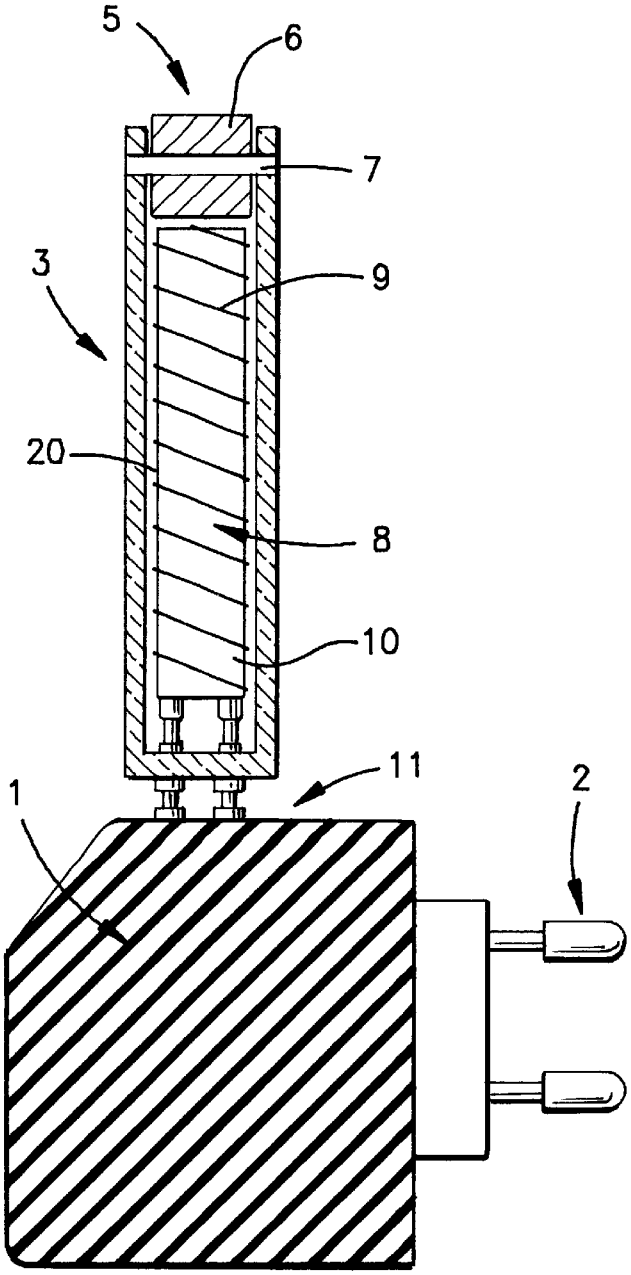
FIG. 1 represents an embodiment of the device according to the invention, in which an applicator, seen along a vertical section, has been arranged on its power supply block serving as a seat.

An applicator system of thermofusible material, especially hair removal wax, complying with the invention and represented more particularly on FIG. 1, comprises an electric power supply block and an applicator 3 of the thermofusible material 20.

The electric power supply block 1 is fitted with a jack 2 or domestic plug enabling to connect the former to the mains. Advantageously, this power supply block 1 delivers a very low voltage, for instance ranging between 2.5 and 6 volts. This very low voltage enables, on the one hand, simple design of the applicator and, on the other, provides the whole system with a high level of protection against electric risks.

Figure 2:
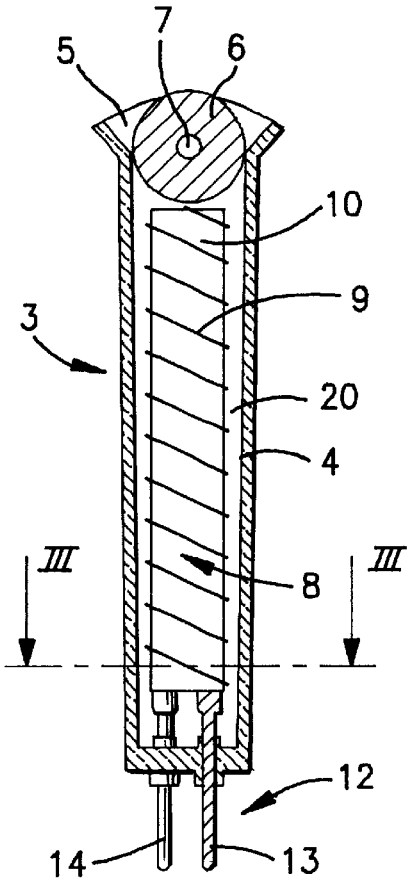
FIG. 2 represents a partial cross-section of the thermofusible material applicator, visible on FIG. 1.

The applicator 3 is represented on FIGS. 1 and 2 as vertical sections, mutually perpendicular, seen in the heating position of the applicator. The latter comprises a reservoir 4 designed for containing the thermofusible material 20. The thermofusible material 20 can be inserted in the form of solid granulates or, in liquid, hot condition. The reservoir 4 can be refillable or, preferably, filled during its manufacture and disposed after usage. This reservoir 4 also serves as a body, i.e. it enables manual pick-up of the applicator and its manipulation, which can be operated with one hand.

A distribution element has been arranged outside an outlet opening 5 of the reservoir 4. This distribution element mainly comprises a roller 6, mobile in rotation around an axis 7. The axis 7 can be mounted rigidly either on the roller 6 or on the side flanks of the reservoir 4.

Inside the reservoir 4 have been arranged heating means 8. These are thus directly in contact with the thermofusible material 20. These heating means are composed essentially of a resistive heating wire 9, mounted on an insulating support 10. Advantageously, the electric wire 9 is a copper wire, which can be enamelled, insulated or not. Electric connection means 11 enable linkage of the power supply block 1 to the heating means 8, and more precisely to the resistive wire 9.

When electric supply is applied to the resistive wire 9, the latter heats up and enables calorific supply to be transmitted directly to the thermofusible material 20 contained in the reservoir 4. Advantageously, the capacity of the reservoir 4 is limited to a volume smaller than 10 $cm^3$ and preferably equal to 7 $cm^3$, which enables the thermofusible material 20 to melt quickly, the applicator 3 is then ready for use at a very short notice.

The electric connection means 11 are temporary, i.e. they link the low voltage output from the power supply block 1 to the heating means 8 in order to melt the hair removal wax, and the applicator 3 can be disconnected from the power supply block 1 in order to enable the application of the thermofusible material. This characteristic thus enables the applicator 3 to be quite handy and notably the user may use it with one hand as well as to reach areas of her body which are difficult to access. This is all the more the applicator 3 to be of small dimension and the distribution element, more precisely the roller 6, also to be of small dimension and for instance less than 2 cm in diameter and also less than 2 cm in length, enabling an application for instance above the upper lip.

The electric connection means comprise a male section 12, more particularly visible on FIG. 2, consisting of two pins 13 and 14. During the heating stage, this male section 12 is connected to a female section attached to the power supply block 1 and constituting its low voltage output. Each pin 13, 14 is linked to one end of the heating wire 9. Both these pins 13, 14 thus enable to ensure an electric link between the power supply block 1 and the resistive wire 9, during the heating stage, but it also ensures, during this same stage, a mechanical link between the applicator 3 and the power supply block 1, the latter serving thus as a support or seat for the applicator 3.

Figure 3:
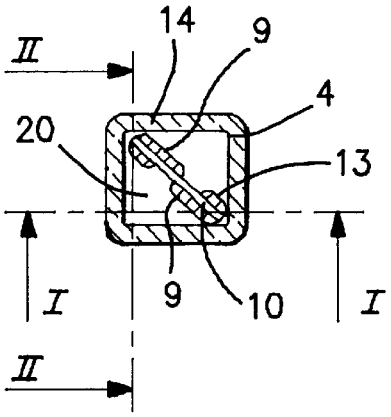
FIG. 3 is a partial section of the thermofusible material applicator.

As can be seen on FIG. 3, the reservoir 4 taken in a section parallel to the application plane, or horizontal view in the heating position of the applicator, has the shape of a quadrilateral, generally rectangular or square. The reservoir 4 is thus more or less a parallelepipedon. Advantageously, the support 10 of the electric wire 9 is placed in a plane corresponding to one of the diagonals of the quadrilateral section. Thus, the heating element is perfectly positioned inside the reservoir 4 and is almost immobile in position, thanks also to both pins 13, 14 attached to the reservoir 4. This accurate positioning of the heating wire 9 is made possible owing to a design and means which are particularly simple, wherein this simple design is readily miniaturizable.

In the preferred embodiment of the invention, the reservoir 4 is constituted by a plastic material.

The particularly simple design of the applicator 3 enables the reservoir 4 to be of single fill-up version. The applicator system 3 can then be discarded when the reservoir 4 is empty, i.e. when it does not contain any more thermofusible material.

Advantageously, at least one of the walls of the reservoir 4 is partially made of a light-transparent material. This transparent section constitutes a window which enables the user to control the filling level of the thermofusible material 20. The filling level of the reservoir 4 is particularly easy to observe.

In order to be able to control the filling level, it is also possible that one of the walls of the reservoir, or the whole reservoir 4 itself, is constituted completely of light-transparent materials. Such materials are generally poor heat conductors and thus, in the case of a reservoir made completely of this material, thermal insulation increases. Since the heating elements are located inside the reservoir 4, calorific losses are thus minimized and the efficiency of the heating means is maximized.

The characteristic of single filling or of disposable applicator, facilitates still further, for the user, the possible cleaning operations and limits the risk of soiling the environment.

At rest, before usage, the applicator 3 is cold and the thermofusible material 20 that it contains, is solid. When she wants to use the applicator, the user will fix it on the power supply block 1, itself connected to the mains. The temperature of the heating means then rises, which causes the thermofusible material to melt. The applicator 3 is then disconnected from the power supply block and because of the thermal inertia of the system, the thermofusible material remains at the requested temperature, enabling it to be applied. The thermofusible material 20 can thus be coated. If necessary, after application of a first strip of thermofusible material 20, the applicator 3 is again put on the power supply block in order to increase the temperature and hence the fluidity of the thermofusible material. The application of another strip can thus be performed.

The invention does not limit itself to the details of the embodiments described previously, but covers notably variations making use of equivalent means. Different variations of this device are possible, especially in the arrangement of the resistive wire 9. This heating wire 9 can be spread on its support 10 by wraps whose density can be evenly distributed over the height of the reservoir 4. These wraps can be distributed in order to heat closer to the distribution roller 6 or closer to the base of the reservoir 4 and to the pins 13, 14 so that the warm-up time can be reduced during the first use or when the reservoir is partially empty during the use.

What is claimed is:

1. An applicator system for thermofusible material, comprising:

an electrical power supply;

an applicator having a reservoir for containing the thermofusible material, said reservoir having an outlet;

electric heating means in said reservoir in contact with the thermofusible material for heating the thermofusible material; and electrical connection means for removably connecting said power supply to said electric heating means to heat the thermofusible material and for disconnecting said power supply from said heating means during application of the thermofusible material, wherein said electric heating means comprises a wire wrapped around a planar support, and wherein said reservoir is a parallelepiped, said planar support having a width that extends between diagonally opposite corners of said parallelepiped and that is greater than a largest width of said parallelepiped.

2. The applicator system according to claim 1, wherein said applicator further comprises a distribution element at the outlet of the reservoir.

3. The applicator system according to claim 2, wherein the distribution element is a cylindrical roller.

4. The applicator system according to claim 3, wherein the distribution roller is less than 2 cm in diameter and less than 2 cm in length.

5. The applicator system according to claim 1, wherein said electrical connection means comprises a male section, fitted with two pins attached to the reservoir and connected to the electric heating means, electrically connecting the electric heating means to the power supply and mechanically connecting the applicator to the electric power supply, said electric power supply thereby serving as a support.

6. The applicator system according to claim 1, wherein said reservoir comprises plastic.

7. The applicator system according to claim 1, wherein at least one of the walls of the reservoir comprises a light-transparent material.

8. A thermofusible material applicator, comprising:

a power supply block for delivering voltage in a range of 2.5 to 6 volts;

a parallelepiped reservoir with a volume not greater than 10 $cm^3$ for containing thermofusible material and an outlet;

a cylindrical distribution roller, located outside said outlet, having a diameter less than 2 cm and a length less than 2 cm;

electric heating means in said reservoir for heating the thermofusible material including a resistive electric wire wrapped around a planar support, said planar support having a width that extends between diagonally opposite corners of said parallelepiped reservoir and that is greater than a largest width of said parallelepiped to increase a heating area of the heating means relative to said volume of said reservoir; and electrical connection means for removably connecting said power supply block to said heating means to heat the thermofusible material.

9. An applicator system for thermofusible material, comprising:

an electrical power supply block delivering voltage in a range of 2.5 to 6 volts;

an applicator having a reservoir with a volume not greater than 10 $cm^3$ for containing the thermofusible material for facilitating handheld use of the applicator, said reservoir having an outlet;

electric heating means in said reservoir in contact with the thermofusible material for heating the thermofusible material; and electrical connection means for removably connecting said power supply block to said electric heating means to heat the thermofusible material and for disconnecting said power supply block from said heating means during application of the thermofusible material, wherein said electric heating means comprises a resistive electric wire wrapped around a planar support, and wherein said reservoir is a parallelepiped, said planar support having a width that extends between diagonally opposite corners of said parallelepiped and that is greater than a largest width of said parallelepiped, to increase a heating area of the heating means relative to said volume of the reservoir.

10. The applicator system according to claim 9, wherein said applicator further comprises a distribution element outside the outlet of the reservoir.

11. An applicator system according to claim 10, wherein the distribution element is a cylindrical roller.

12. An applicator system according to claim 11, wherein the distribution roller is less than 2 cm in diameter and less than 2 cm in length.

13. An applicator system according to claim 9, wherein said electrical connection means comprises a male section, fitted with two pins attached to the reservoir and connected to the electric heating means, electrically connecting the electric heating means to the power supply block and mechanically connecting the applicator to the electric power supply block, said electric power supply block thereby serving as a support.

14. An applicator system according to claim 9, wherein said reservoir includes a plastic material.

15. An applicator system according to claim 9, wherein at least one of the walls of the reservoir partially constitutes a light-transparent material.

* * * * *